United States Patent [19]

Reynolds

[11] Patent Number: 4,909,424

[45] Date of Patent: Mar. 20, 1990

[54] KNIFE SHEATH

[76] Inventor: William R. Reynolds, 1556 Memorial Dr., Calumet City, Ill. 60409

[21] Appl. No.: 386,974

[22] Filed: Jul. 31, 1989

[51] Int. Cl.[4] ..... B26B 29/02

[52] U.S. Cl. ..... 224/232; 30/158; 224/197

[58] Field of Search ..... 224/232, 197, 200, 225, 224/233, 234, 242, 250, 253; 30/143, 151, 158, 155

[56] References Cited

U.S. PATENT DOCUMENTS

| | | | |
|---|---|---|---|
| 1,028,008 | 5/1912 | Eslick, Jr. | 30/151 |
| 4,426,779 | 1/1984 | Morgan | 30/158 |
| 4,494,310 | 1/1985 | Slaughter | 30/151 |
| 4,525,928 | 7/1985 | Foster | 224/232 |
| 4,561,577 | 12/1985 | Moore | 224/232 |
| 4,600,133 | 7/1986 | Maihos | 224/253 |

*Primary Examiner*—Linda J. Sholl

[57] ABSTRACT

A safety holster for a folding knife having a handle and a folding blade with the holster having a frame formed of side plates with an upper spacer and a lower pivotal blade sheath having an upwardly facing pocket for the tip of a folding blade with the pocket pivoting from a vertical upwardly facing position to a downwardly facing position to drawn the knife blade away from the knife handle to a use phase when the handle is drawn downwardly and permit the knife handle to be drawn upwardly without drawing the blade away from the handle.

15 Claims, 2 Drawing Sheets

KNIFE SHEATH

BACKGROUND OF THE INVENTION

The present invention relates to improvements in safety holders for folding knives having a handle and a folding blade and in particular a holster which retains and protects the blade in a carrying phase of operation and draws the blade away from the handle to open position as the handle is slid downwardly in a use phase.

Prior developments in this field have provided knife supporting holsters or scabbards for safely carrying folding knives. These developments have enabled the user to carry a folding knife, such as from the user's belt, and to pull the knife from the scabbard with one hand with the scabbard operating to open the knife blade as the knife is being withdrawn. These knives may be generally called clasp knives and have a knife handle with a folding blade pivoted to the handle at one end. The blade is folded into the handle in a non-use safety position and is withdrawn from the handle to be open and parallel thereto when the knife is to be used. These knives are used for various purposes, and are frequently used by hunters or outdoorsmen who for convenience would like to carry the knife in a holster worn from the belt so that it is easily and readily accessible. If carried in a holster, it does not take space in the outdoorsman's pocket nor is it inaccessible as it would be if carried in a knapsack.

When used by outdoorsmen, these folding knives can be of substantial size and can be used for multitudinous purposes. A knife is a favored tool for the outdoorsman both for all of the uses needed as well as for defensive purposes. Such needs must provide that the knife is carried in a safe manner so that the edge is not exposed and yet carried so that the outdoorsman can easily reach the knife with one hand. An added requisite is that the outdoorsman must be able to remove the knife from the holster in a manner so that the blade automatically opens and does so in a safe manner without the possibility of cutting the hand or clothing of the user.

The prior art shows many attempts to provide a suitable holster for carrying a folding knife and various disclosures of holsters may be found in U.S. Pat. Nos. 4,426,779, Morgan, Issued Jan. 24, 1984; 4,494,310, Slaughter, Issued Jan. 22, 1985; 4,525,928, Foster, Issued July 2, 1985; 4,561,577, Moore, Issued Dec. 31, 1985; and 4,600,133, Maihos, Issued July 15, 1986. While these patents show various approaches to the problem, each different from the other, it will be apparent to those versed in the art that there are features necessary or desirable to the sportsman, outdoorsman and hunter which are not provided.

One important feature which the prior art does not provide is that it is advantageous if the folding knife can be withdrawn in a manner so that the blade is automatically opened, or alternatively at the option of the user, the knife can be withdrawn without the blade being opened. With this feature, depending upon the exigencies of the situation, the user can have the knife immediately ready for action or can withdraw the knife to hand to others or choose to open the knife in a conventional manner such as he might wish to do if he shifts the knife to his other hand.

Another feature which would be highly advantageous which could be attained would be that the knife holster could be readily adapted in its existing construction for use at either the left or right hand side of the user for either a right of left handed person. A further very important feature to be attained is to provide a holster which allows for the blade to be automatically open when withdrawn from the holster, but which protects the blade substantially preventing it from cutting the user during the withdrawal operation.

It is accordingly an object of the present invention to provide an improved folding knife holster which offers an improved construction permitting withdrawal of the knife from the holster with an automatic opening of the blade bu permitting the user to alternately at his option withdraw the knife in a manner such that the blade is automatically opened or withdraw the knife such that the blade remains closed and folded against the handle.

A further object of the invention is to provide an improved knife holster wherein the blade edge and blade tip has maximum protection from injuring the user during the withdrawal operation.

A still further object of the invention is to provide an improved knife holster of simplified yet completely reliable construction to insure safety and reliability of operation.

FEATURES OF THE INVENTION

In accordance with the principles of the invention, the structure embodies an elongated frame having side plates held apart by an upper spacer and having a lower pivotal blade sheath which is constructed in a manner so that it has a pocket receiving the blade of a knife. The blade tip is carried in the pocket and is essentially protected during the whole time that the blade is drawn downwardly by its handle from a knife carrying phase to a knife use phase. The blade protecting sheath is spring biased so that it will automatically move back to the recess position after the knife is withdrawn. The knife can also be withdrawn vertically upwardly with the blade moving out of the sheath without opening the blade giving the user the option of either use. The construction can be readily adapted to be carried on the belt of the user on either side for a right or left hand user and the knife is compact and completely secure in a vertical position fully accessible to the user.

Other objects, advantages and features will become more apparent with the teaching of the principles of the invention in connection with the disclosure of the preferred embodiment thereof in the specification, claims and drawings in which:

DESCRIPTION OF THE PREFERRED EMBODIMENT

Figure 1:
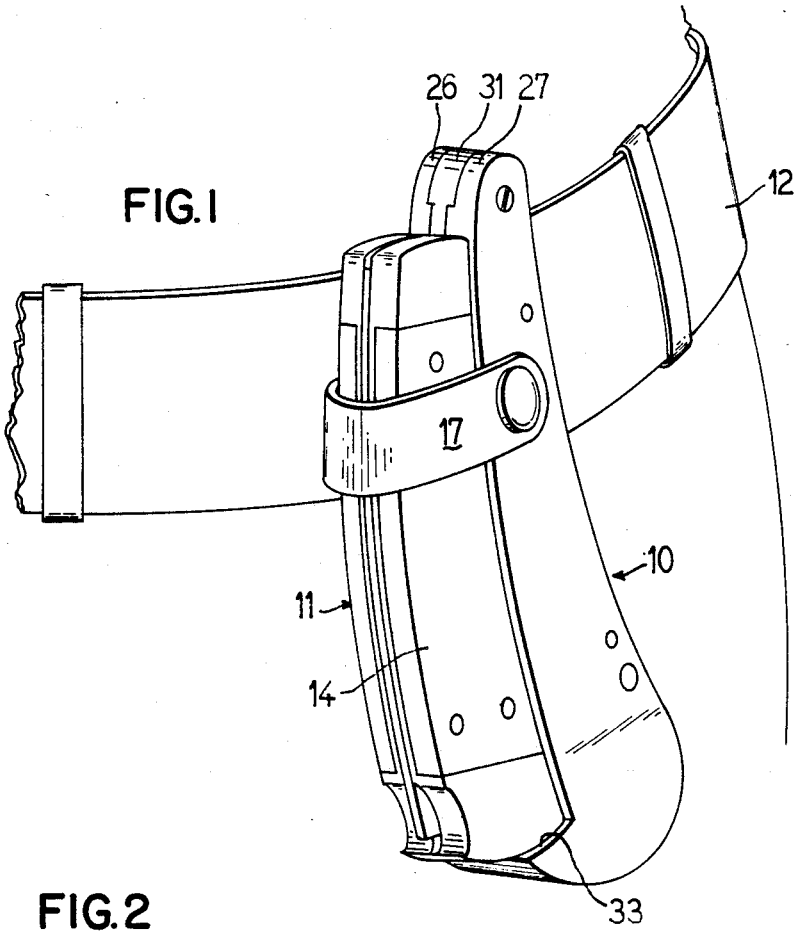
FIG. 1 is a perspective view of the safety holder of the invention carried on the belt of a user.

As shown in FIG. 1, a safety holster 10 is provided for carrying a folding knife 11. The knife is of a well known type having a handle 14 with a folding blade 15 which pivots on the handle to move between a closed position where it is substantially carried while on the holster 10 for an open position where the blade is pulled to the fully opened position in alignment with the handle as the handle is pulled downwardly in the manner shown in FIG. 4 in the direction indicated by the arrowed line 14*a*.

Figure 2:
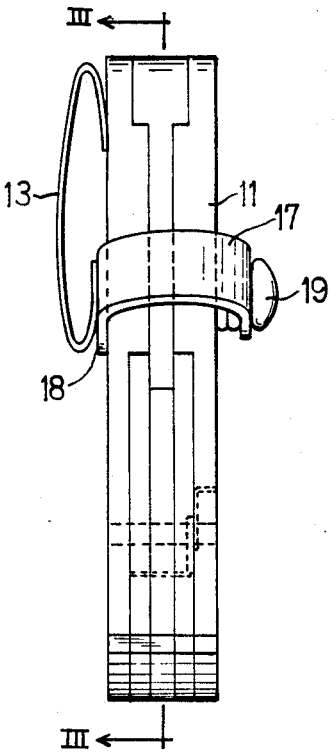
FIG. 2 is a front elevational view of the knife and holster of FIG. 1.

The holster has a vertical holster frame with holding means 17 on the frame for releasably retaining the handle of the knife on the frame during a carrying phase of operation. This holding means is in the form of a strap 17 fixedly secured at 18, FIGS. 1 and 2, to the frame and releasably connected at 19 by a snap fastener. The snap fastener has a pressure closable button with one part of the button 17*a* on the frame, FIG. 4, and the other 17*b* on the strip.

Figure 4:
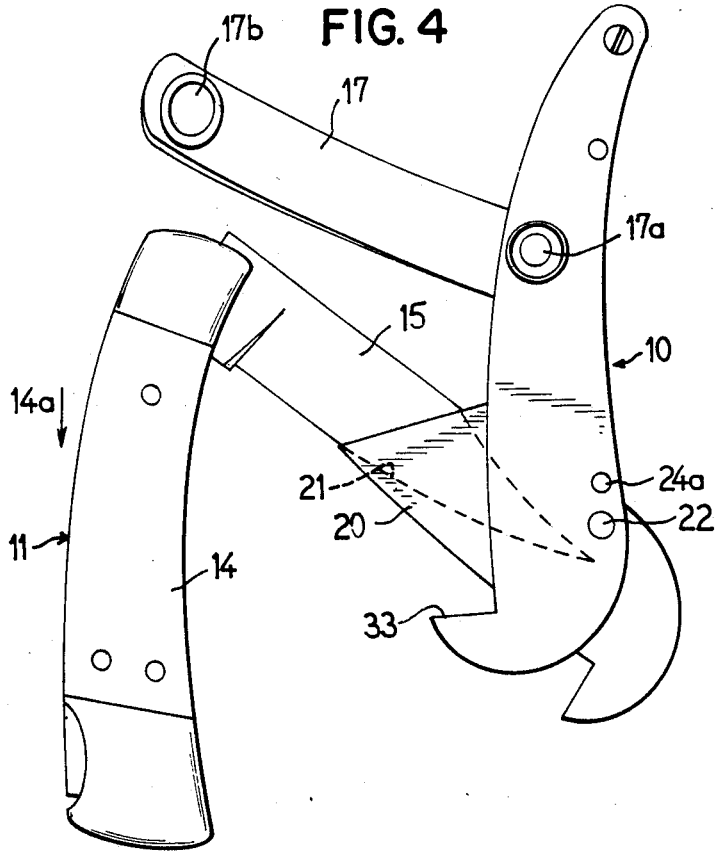
FIG. 4 is an elevational view illustrating the operation of the holster as a knife is being withdrawn.

When the user wishes to withdraw the knife from the holster, the snap 17*b* is first pulled to release the strip 17 and thereby release the handle and the user grips the handle in his hand pushing it downwardly in the direction indicated by the arrowed line 14*a* to open the blade as illustrated in FIG. 4.

At the lower end of the vertical holster is a blade sheath 20 which is pivotally mounted on the frame and has an upwardly opening blade receiving pocket 21. This pocket is shaped and sized to receive the tip of the blade in a safety carrying manner. The holster is pivoted on the frame by a cross fulcrum pin 22.

Figure 3:
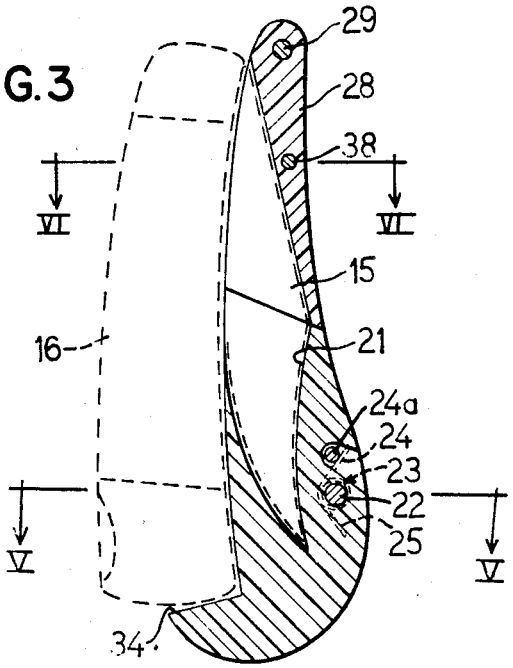
FIG. 3 is a vertical sectional view taken substantially along line III—III of FIG. 2.

The blade sheath 20 freely pivots between a position where it fits within the frame in the carrying phase in the manner shown in FIG. 1. The blade sheath also freely pivots downwardly from the frame in a use phase meanwhile pulling the blade 15 of the knife to open position. When the blade has been fully opened by the handle being pulled fully downwardly, the blade leaves the pocket 21 and the sheath springs back to its carrying position within the frame being urged thereto by a bias spring 23, FIG. 3. This bias spring is carried on the cross pin 22 and has one end 25 based and supported on the frame and the other end 24 engaging a support pin 24*a*. It will be understood by those versed in the art that various other forms of springs may be employed for applying the bias and force to urge the sheath to its retracted carrying position.

Figure 5:
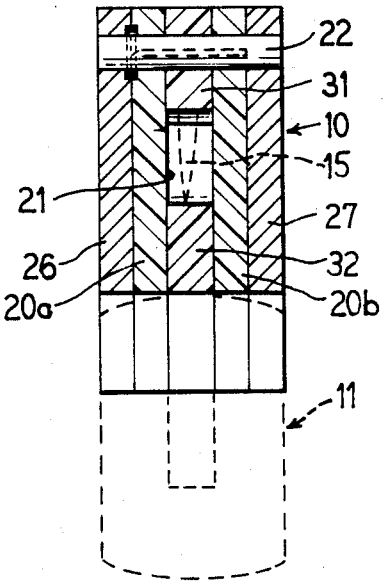
FIG. 5 is a horizontal sectional view taken substantially along line V—V of FIG. 3.
Figure 6:
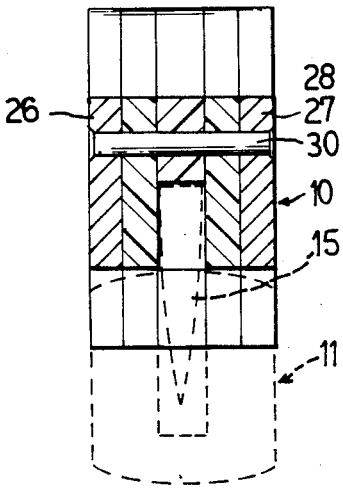
FIG. 6 is a horizontal sectional view taken substantially along line VI—VI of FIG. 3.

The holster frame 10 is preferably constructed of two shaped side plates 26 and 27, FIG. 5 which are held in their spaced apart relationship by a fixed spacer 31. Cross pins such as screws or rivets clamp the side plates 26 and 27 to the spacer 31. The side plates extend downwardly for the full height of the holster so as to provide the space in which the blade sheath pivots.

The blade sheath is constructed by having spaced apart side plates 20*a* and 20*b* held apart by rear and front spacers 31 and 32, FIG. 5. These spacers do not have the same depth as the plates 20*a* and 20*b*, and therefore provide the pocket 21 therebetween into which the blade 15 projects. The front spacer 32 may be formed of a soft non-dulling material so that it can be engaged by the blade without dulling the blade. A soft material such as rubber may be employed or a slippery material such as Teflon and other plastic materials may be used as will be understood by those versed in the art.

The front and rear spacers 31 and 32 are held between the plates so as to provide the pocket 21 and may be held by pins, not shown, extending through the plates and spacers or by the plates 20*a* and 20*b* being cemented thereto.

In operation, the user carries the holster 10 on his belt in a vertical position. It will be seen that by merely reversing the holding strap 17 so that the snap end is fixed to the frame and the other end is releasably snapped, that the holster frame may be used at either side of the user for either a left hand or a right hander. The supporting strap 13 which carries the frame on the belt will, of course, be also positioned at the other side of the frame for use at the other side of the body of the user.

When the holding strap 17 is released, the user grasps the handle of the knife pulling it surely and swiftly downwardly in the direction indicated by the arrow 14*a* in FIG. 4. This draws the blade 15 to open position as the blade sheath pivots downwardly. When the knife is fully downward and the blade pulled out of the pocket 21 in the sheath, the sheath will pivot back to the position within the frame.

If the user desires to withdraw the knife in a manner so that the blade is not opened, he follows the same initial procedure by releasing the strap 17 and then lifts the handle 14 upwardly in the direction opposite the arrow 14*a*. This will merely slide the blade out of the pocket and allow it to move into the recess of the handle 14.

When the user moves the knife from the carrying phase to the use phase as shown in FIG. 4 and use is complete, he merely inserts the tip of the blade 15 back into the pocket of the sheath, which is fully exposed in an upward direction, and then rotates the handle 14 downwardly until the handle is in the position shown in FIG. 1 against the frame. The strap 17 is then snapped back into place so that the knife is fully add surely retained and held on the holster frame 10.

The construction is fabricated from few parts which are very strong and rigid when in their relative position illustrated in the drawings. It will be understood by those versed in the art that while the side plates are preferably formed of aluminum or metal, they may be formed of a relatively rigid plastic and all parts may be formed of various substitutable materials and the preferred embodiment is illustrated by way of a preferred example. Thus, there has been provided a safety holster which meets the objects and advantages above set forth and provides a carrier for a knife holding it in the optimum vertical position ready for easy grasping to be removed from the carrying phase to the use phase either upwardly or downwardly to a folded blade or an open blade position.

I claim as my invention:

1. A safety holster for a folding knife having a handle and a folding blade comprising in combination:

a holster frame with means for supporting the frame to carry a folding knife from a garment of the user;

holding means on the frame for releasably retaining the handle of the knife on the frame during a carrying phase of operation, the holding means being releasable for allowing the user to grip the knife and draw it downwardly from the frame in a use phase;

and a blade sheath pivotally mounted on the frame having an upwardly opening blade receiving pocket, said sheath pocket pulling the blade outwardly away from the knife handle as the handle is forcibly drawn downwardly along the frame so that the blade is automatically moved to open use position relative to the handle and so that the handle can be drawn upwardly with the blade withdrawing from the pocket without being moved to open use position relative to the handle.

2. A safety holster for folding knife having a handle and a folding blade constructed in accordance with claim 1:

wherein the blade sheath pivots between a blade retention position with the handle held on the frame and a second blade opening position when the handle is drawn downwardly;

and a spring return urging the sheath to blade retention position so that the sheath will automatically return to the retention position when the knife is fully withdrawn.

3. A safety holster for a folding knife having a handle and a folding blade constructed in accordance with claim 1:

wherein said pocket has a surface of non-dulling material facing a cutting edge of the blade.

4. A safety holster for a folding knife having a handle and a folding blade constructed in accordance with claim 1:

wherein said holding means is in the form of a releasable strap embracing the handle and holding it against the frame during said carrying phase.

5. A safety holster for a folding knife having a handle and a folding blade constructed in accordance with claim 1:

wherein said frame is constructed of metal and the blade sheath is constructed of plastic.

6. A safety holster for a folding knife having a handle and a folding blade constructed in accordance with claim 1:

wherein the frame is constructed of side plates extending vertically the full length of the holster.

7. A safety holster for a folding knife having a handle and a folding blade constructed in accordance with claim 6:

wherein the sheath is pivotally mounted between said side plates with a pivotal fulcrum extending between and supported on the side plates.

8. A safety holster for a folding knife having a handle and a folding blade constructed in accordance with claim 1:

wherein said blade sheath is constructed of spaced side plates with front and rear spacers defining said pocket therebetween.

9. A safety holster for a folding knife having a handle and a folding blade constructed in accordance with claim 6:

wherein said blade sheath is pivoted between the side plates;

and a torsion spring supported on the side plates in engagement with the blade sheath for urging it to a position between the plate.

10. A safety holster for a folding knife having a handle and a folding blade constructed in accordance with claim 1:

including an upwardly facing support shelf at the lower end of the frame for engagement with the handle of the knife in the carrying phase of operation.

11. A safety holster for a folding knife having a handle and a folding blade constructed in accordance with claim 10:

wherein said blade sheath has an upwardly facing shelf in alignment with the shelf of the frame for the support of the handle of the knife.

12. A safety holster for a folding knife having a handle and a folding blade constructed in accordance with claim 6:

including an upper spacer between the side plates maintaining the side plates apart a predetermined distance with the blade sheath pivotally mounted between the plates in the space defined therebetween below said spacer.

13. A safety holster for a folding knife having a handle and a folding blade constructed in accordance with claim 1:

wherein the blade sheath is mounted for pivotal movement through an arc approaching 180° so that the blade remains in the sheath in movement from the carrying phase to the use phase with the handle fully below the blade.

14. A safety holster for a folding knife having a handle and a folding blade comprising in combination:

a holster frame including opposed laterally spaced vertical side plates;

a supporting means on the frame for carrying the folding knife from a belt of the user;

a strap secured at one end to one frame plate and releasably secured at the other end to the other frame plate for embracing and retaining the handle of the knife on the frame during a carrying phase of the operation with the strap being releasable to allow the user to grip the knife and draw it downwardly from the frame in a use phase;

a spacer plate at the upper end of the frame spacing the frame plates;

a blade sheath pivotally mounted on the frame between the lower end of the frame plates and having an upwardly opening blade receiving pocket;

a cross-pivot fulcrum extending between the frame side plates providing a pivotal mount for the blade sheath;

said blade sheath having spaced side plates with front and back spacers therebetween defining the pocket for the blade with the spacer facing the cutting edge of the knife being of a non-blade-dulling material;

a torsion spring connected between the blade sheath and the frame plates for urging the blade sheath to a position between the frame plates in the carrying phase of operation;

an upwardly facing shelf on the frame plates at the lower end for supporting the blade handle;

and an upwardly facing shelf on the blade sheath in alignment with the shelf of the frame;

said sheath pocket having pivotal movement through an angle approaching 180° from the carrying phase between the plates to a downwardly facing position of the pocket so that the blade remains in the pocket until the knife is essentially withdrawn to its lowermost position.

15. A safety holster for a folding knife having a handle and a folding blade comprising in combination:

a holster frame with means for supporting the frame to carry a folding knife from a garment of the user;

holding means on the frame for releasably retaining the handle of the knife on the frame during a carrying phase of operation, the holding means being releasable for allowing the user to grip the knife and draw it downwardly from the frame in a use phase;

a blade sheath pivotally mounted on the frame having an upwardly opening blade receiving pocket;

and a folding knife carried on the holster frame with the handle supported by said holding means and the tip of the knife inserted in the pocket in the blade sheath, said sheath pocket pulling the blade outwardly away from the knife handle as the handle is forcibly drawn downwardly along the frame so that the blade is automatically moved to open use position relative to the handle and so that the handle can be drawn upwardly with the blade withdrawing from the pocket without being moved to open use position relative to the handle.

* * * * *